US007896332B2

(12) United States Patent
Terao

(10) Patent No.: US 7,896,332 B2
(45) Date of Patent: Mar. 1, 2011

(54) BELT DRIVING MECHANISM, IMAGE FORMING APPARATUS INCLUDING THE SAME, AND METHOD FOR DRIVING BELT

(75) Inventor: Yasunobu Terao, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 232 days.

(21) Appl. No.: 12/255,568

(22) Filed: Oct. 21, 2008

(65) Prior Publication Data

US 2009/0101481 A1 Apr. 23, 2009

Related U.S. Application Data

(60) Provisional application No. 60/982,102, filed on Oct. 23, 2007.

(51) Int. Cl.
*B65H 37/04* (2006.01)

(52) U.S. Cl. ..... 270/58.11; 198/834; 198/835

(58) Field of Classification Search ..... 270/58.11; 198/834, 835
See application file for complete search history.

(56) References Cited

U.S. PATENT DOCUMENTS 7,681,717 B2 * 3/2010 DeGroot ..... 198/832
2007/0137986 A1 * 6/2007 Lindvall ..... 198/835
2009/0008224 A1 * 1/2009 DeGroot ..... 198/834
2009/0160115 A1 * 6/2009 Iguchi et al. ..... 270/58.09

FOREIGN PATENT DOCUMENTS

| | | |
|---|---|---|
| JP | 2006-96453 | 4/2006 |
| JP | 2007-076893 | 3/2007 |
| JP | 2007-84255 | 4/2007 |
| JP | 2007-84256 | 4/2007 |
| JP | 2007-84257 | 4/2007 |

* cited by examiner

*Primary Examiner*—Patrick Mackey
(74) *Attorney, Agent, or Firm*—Patterson & Sheridan, LLP

(57) ABSTRACT

A belt driving mechanism related to the present invention includes: a toothed drive pulley configure to rotate actively; a toothed driven pulley configured to rotate passively; a toothed belt configured to engage with the toothed drive pulley and the toothed driven pulley by tooth on an inner circumference thereof; and an elastic member configured to move the toothed belt in a returning direction by an elastic force accumulated while the toothed drive pulley moves the toothed belt in a going direction, wherein at least one of the toothed belt, the toothed drive pulley, and the toothed driven pulley is formed such that at least one of tooth bottoms is shallower than at least other one of the tooth bottoms.

20 Claims, 12 Drawing Sheets

BELT DRIVING MECHANISM, IMAGE FORMING APPARATUS INCLUDING THE SAME, AND METHOD FOR DRIVING BELT

CROSS-REFERENCE TO RELATED APPLICATION

This application is based upon and claims the benefit of priority from U.S. provisional application 60/982102, filed on Oct. 23, 2007, the entire contents of each of which are incorporated herein by reference.

TECHNICAL FIELD

The present invention relates to a belt driving mechanism, an image forming apparatus including the same, and a method for driving the belt, and more in particular to a belt driving mechanism for carrying papers by a reciprocating motion in a finisher of an image forming apparatus, an image forming apparatus including the same, and a method for driving the belt.

BACKGROUND

Recently, an image forming apparatus of an electrophotographic scheme such as a laser printer, a digital copier, or a laser facsimile is equipped with a post-processing device (finisher) which staples or sorts a bunch of papers, as disclosed in, for example, JP-A 2007-76893.

In the finisher, a reciprocating motion of an assist arm (an ejector) is carried out by, for example, a reciprocal motion of a belt (hereinafter, referred to as "an eject belt") to which the ejector is fixed, as shown in JP-A 2007-76893.

In order to increase a throughput of a stapling processing or sorting processing performed repeatedly, it is required to increase a moving speed of the ejector in the returning path as well as in the going path. In addition, the ejector is required to stop at the home position accurately and further surely. In order to satisfy these requirements, a torsional coil spring with a large elastic force it is require is used for the movement of the returning path.

Meanwhile, a protrusion is provided on a predetermined position of the eject belt. The protrusion collides with a belt stopper fixed outside the eject belt, thereby stopping the movement of the eject belt in the returning direction. The stop position of the eject belt is adjusted such that the ejector stops at the home position.

Due to the large elastic force of the torsional coil spring, the eject belt accelerates considerably right before the protrusions thereof collide with the belt stopper.

As a result, conventionally, the protrusions on the eject belt collide with the belt stopper for stopping in an impact manner, thereby generating an impact sound. When the stapling processing or the sorting processing is performed repeatedly, the impact sound is also generated repeatedly.

SUMMARY

The present invention is designed in consideration of such situation, an object of which is to provide a belt driving mechanism, an image forming apparatus including the same and a method for driving a belt, capable of preventing an impact sound using a very simple configuration without decreasing a movement speed of the belt, in the belt driving mechanism to perform a reciprocating motion.

In order to accomplish the above object, a belt driving mechanism related to one aspect of the present invention includes: a toothed drive pulley; a toothed driven pulley; a toothed belt to engage with the toothed pulleys by tooth on an inner circumference thereof; and an elastic member to move the toothed belt in a returning direction by an elastic force accumulated while the toothed drive pulley moves the toothed belt in a going direction. At least one of the toothed belt, the toothed drive pulley, and the toothed driven pulley is formed such that at least one of tooth bottoms is shallower than at least other one of the tooth bottoms.

An image forming apparatus related to another aspect of the present invention comprises: a printer to print images on a plurality of papers; a processing tray to stack papers to match end portions of the papers; a stapler to staple the papers; and the above belt driving mechanism.

In addition, relating to another aspect of the invention, a method for driving a belt that has the above belt driving mechanism includes: moving the toothed belt in a going direction to move the hook from a first position to a second position, by a driving force of a motor; and moving the toothed belt in a returning direction to return the hook from the second position to the first position, by an elastic force accumulated in an elastic member while the toothed drive pulley moves the toothed belt in a going direction.

DETAILED DESCRIPTION

Hereinafter, embodiments of a belt driving mechanism, an image forming apparatus including the same and a belt driving method related to the present invention will be described with reference to the accompanying drawings.

(1) Image Forming Apparatus

Figure 1:
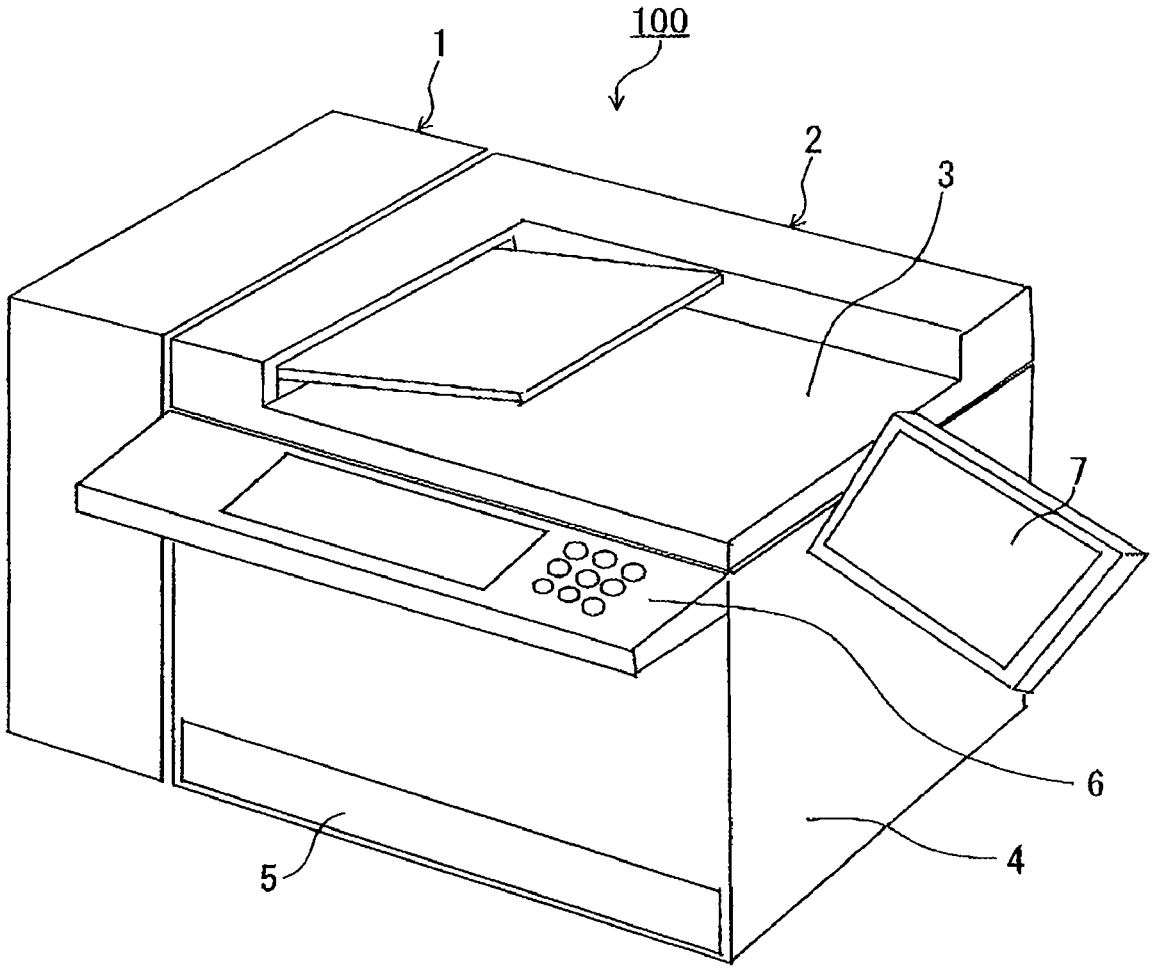
FIG. 1 is a perspective view to illustrate an example of an appearance of an image forming apparatus related to the present embodiment.

FIG. 1 is a diagram to illustrate an exemplary appearance of a copier (or an MFP) as a model of an image forming apparatus 100 related to the present embodiment.

The image forming apparatus 100 includes a printer 2 and a finisher 1. The printer 2 includes a read-out unit 3, an image forming unit 4 and a paper supply unit 5 and the like.

The read-out unit 3 optically reads out an original document mounted on a document plate or an original document inputted in an ADF (Auto Document Feeder) to generate image data.

The image forming unit 4 prints the image data on a paper supplied from the paper supply unit 5 by use of an electrophotographic scheme. The image forming unit 4 is provided with a control panel 6 where a user performs a variety of operations and a display panel 7 for displaying a variety of information.

The finisher 1 is a device for performing post-processing such as a sorting processing of, or a stapling processing of a paper P printed in the printer 2.

Figure 2:
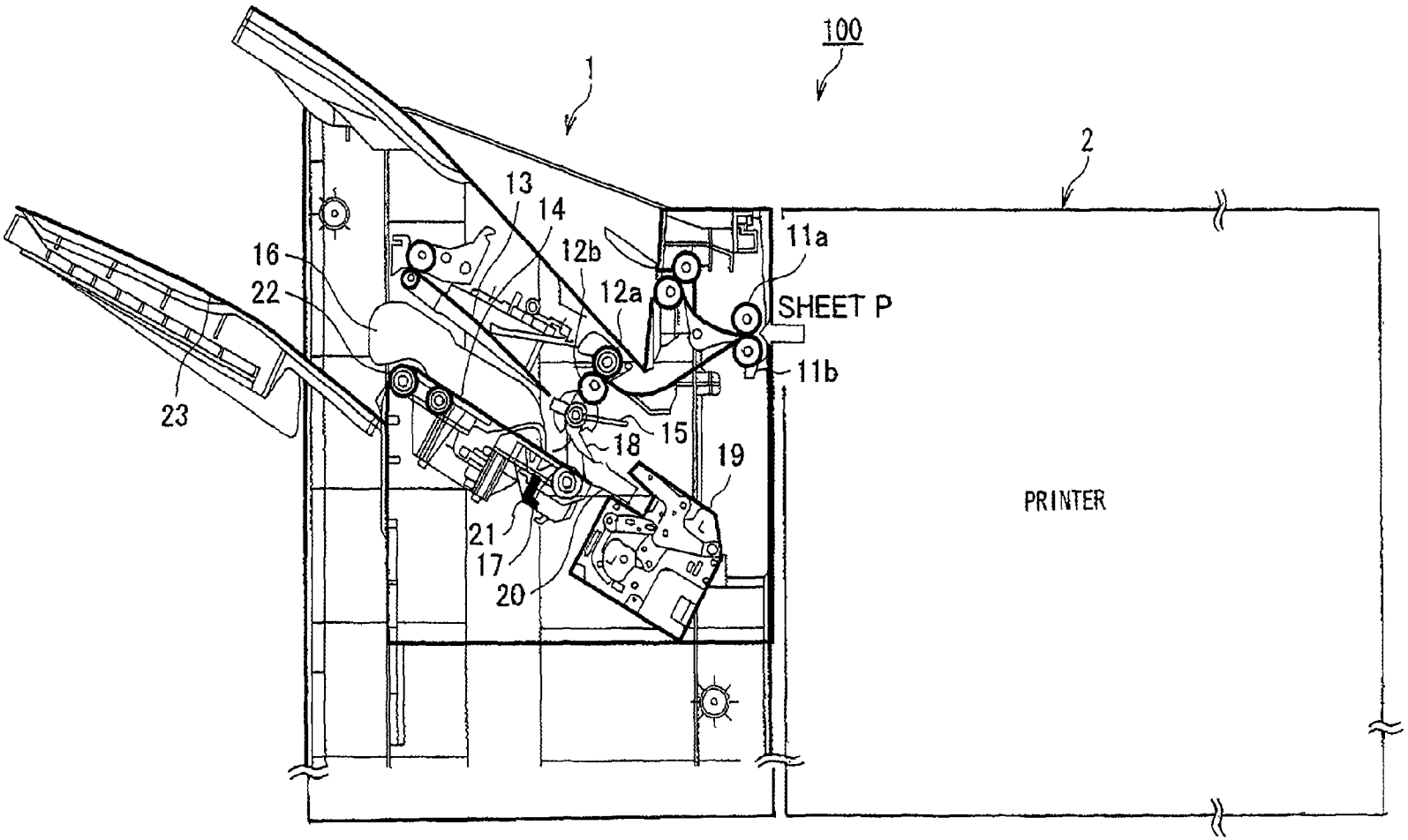
FIG. 2 is a diagram to in detail illustrate an exemplary configuration of a finisher of the image forming apparatus related to the present embodiment.
Figure 3:
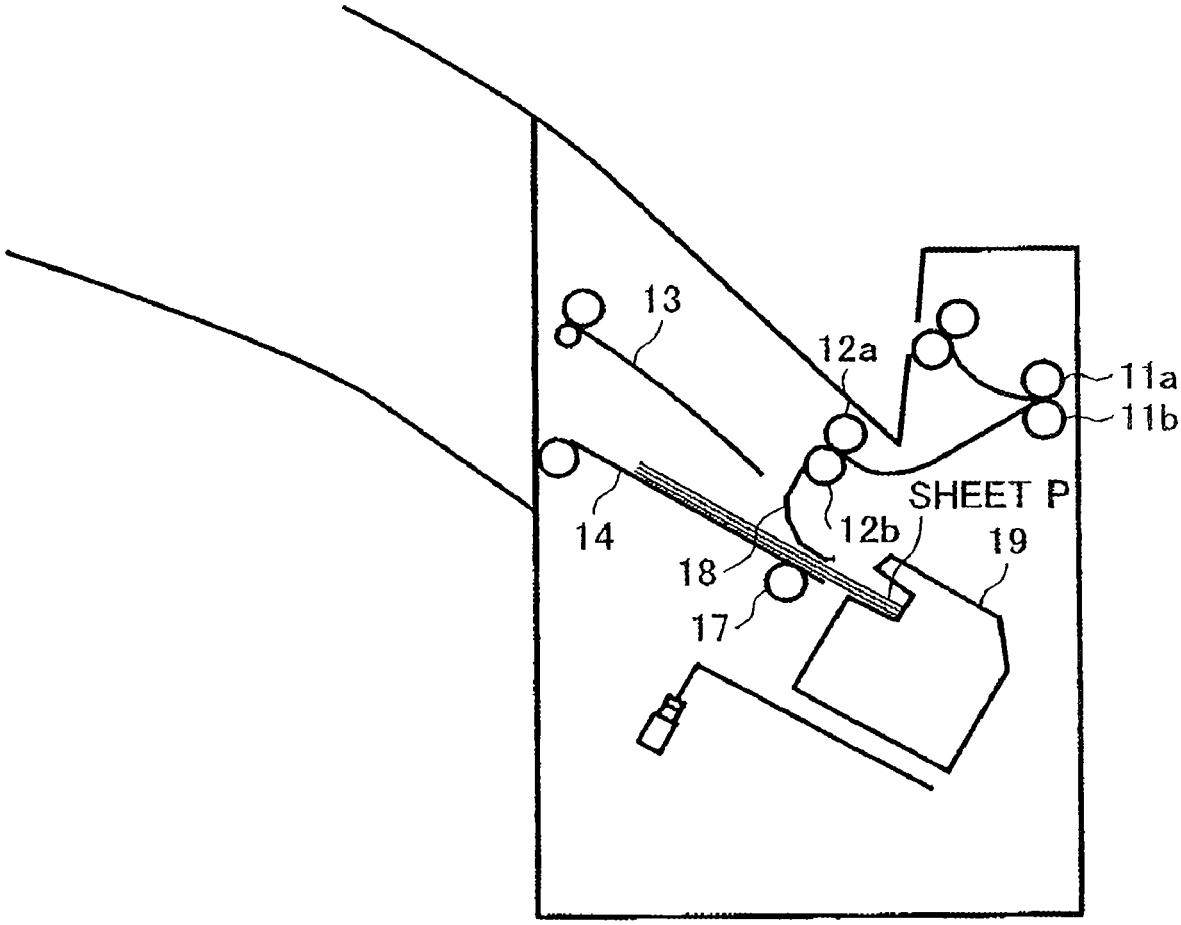
FIG. 3 is a diagram to schematically illustrate a configuration of the finisher.

FIG. 2 is a diagram to in detail illustrate an exemplary configuration of specially the finisher 1 of the image forming apparatus 100 related to the present embodiment. Further, FIG. 3 is a diagram to schematically illustrate a configuration of the finisher 1.

Entrance rollers 11*a* and 11*b* configured of a pair of rollers are provided on the lateral side of the finisher 1 adjacent to the printer 2. The entrance rollers 11*a* and 11*b* receive a print-finished paper supplied from the printer 2. The entrance rollers 11*a* and 11*b* carry the received paper P to exit rollers 12*a* and 12*b*.

A stand-by tray 13 is provided in front of the exit rollers 12*a* and 12*b* and temporarily keeps the paper P carried from the exit rollers 12*a* and 12*b*.

If a predetermined keeping period elapses, the stand-by tray 13 opens and drops the temporarily kept paper P on a processing tray 14. A bunch of papers B which are a stack of the papers P are mounted on the processing tray 14.

The processing tray 14 is disposed on a slant in a vertical direction as shown in FIG. 2. A stapler 19 for stapling the bunch of papers B with staples is provided in front of the lower end of the processing tray 14. A loading tray 23 for loading the stapled bunch of papers B is also provided in front of the upper end of the processing tray 14.

A paper guide 18 is provided over the lower end of the processing tray 14 and guides the rear ends of the bunch of the papers B supplied to the processing tray 14 toward the stapler 19.

A transverse matching plate 16 is provided on both sides of the processing tray 14. The transverse matching plate 16 transversely matches the papers P on the processing tray 14. In addition, a longitudinal matching roller 17 is provided on the rear end of the processing tray 14 and a paddle 15 is provided thereover. The paddle 15 and the longitudinal matching roller 17 enable the rear ends of the papers P on the processing tray 14 to collide with a rear stopper 26 to be matched longitudinally.

The papers P are guided to the processing tray 14 via the stand-by tray 13 sequentially and a plurality of papers P are guided to the stapler 19 as a bunch of papers B. If a last paper P of the bunch of papers B is guided to the stapler 19, the stapler 19 staples the vicinity of the rear ends of the bunch of papers B with staples.

The stapled bunch of papers B are hooked in the rear ends thereof by an ejector 20 (hook member) fixed to an eject belt 30 (toothed belt) or a bunch claw 21*a* (carrying hook member) fixed to a bunch claw belt 21 (carrying belt), and are carried toward the loading tray 23 by driving of the eject belt 30 or the bunch claw belt 21. A protruding rod 25 (rod-shaped member) is fixed to the eject belt 30 at an opposite of the ejector 20, and the bunch of papers B are supported by the protruding rod 25 in the bottom thereof and are protruded toward the loading tray 23 and further are discharged to the loading tray 23 by a discharge roller 22. A belt driving mechanism or a belt driving method of the eject belt 30 and the bunch claw belt 21 will be described in detail later.

The loading tray 23 can load many bunches of papers B, and the loading tray 23 moves down gradually as the number of the bunch of papers B loaded thereon increases.

Figure 4:
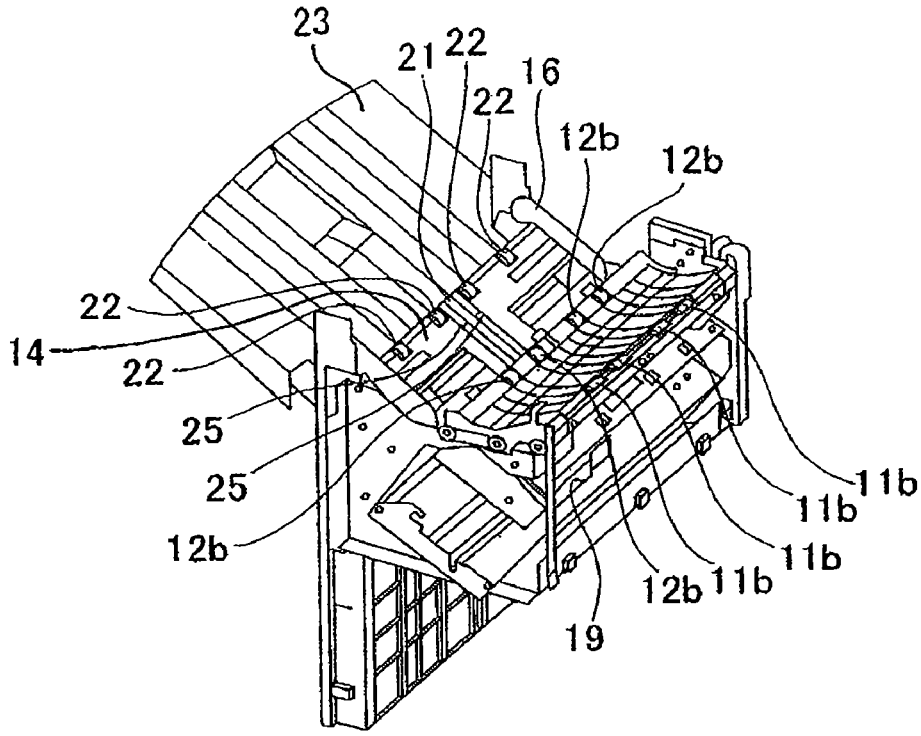
FIG. 4 is a first perspective view to illustrate a configuration of a main part of the finisher.
Figure 5:
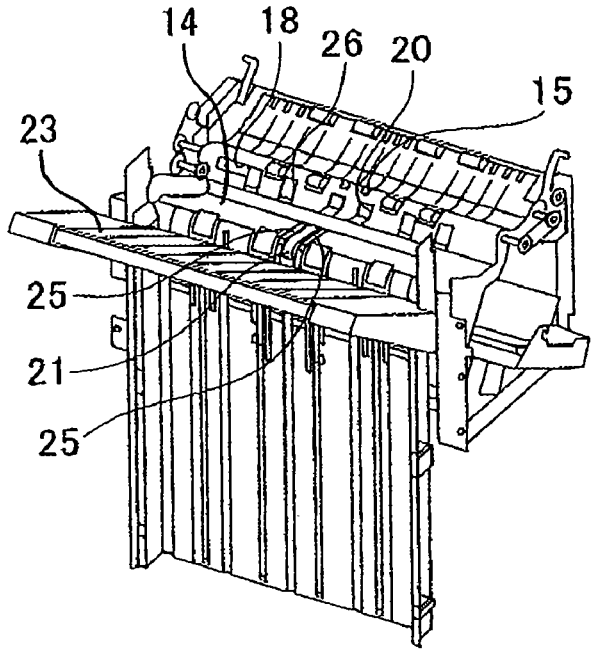
FIG. 5 is a second perspective view to illustrate the configuration of the main part of the finisher.

FIGS. 4 and 5 are perspective views to illustrate a main part of the finisher 1. FIGS. 4 and 5 illustrate an appearance where the stand-by tray 13 and components thereon are removed.

Figure 6:
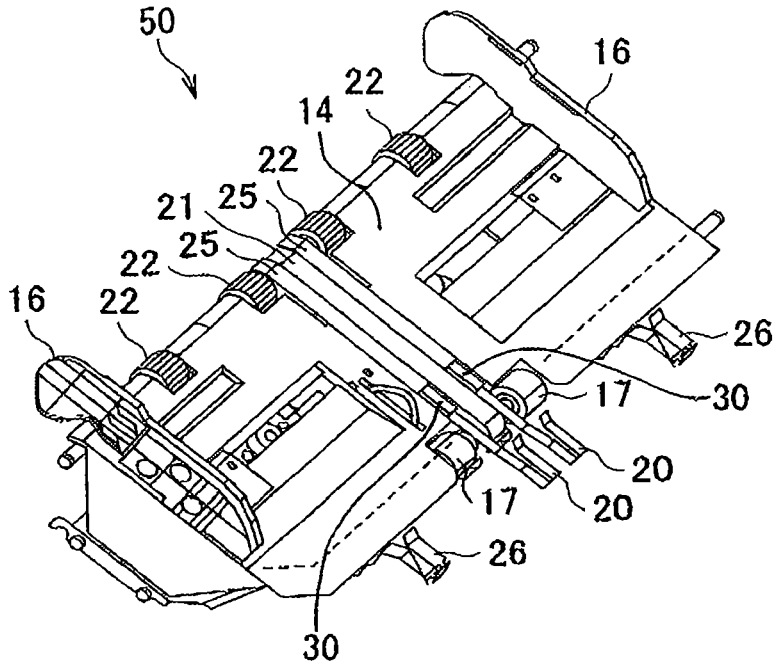
FIG. 6 is a first perspective view to illustrate an exemplary configuration of a processing tray unit.

FIG. 6 is a perspective view to illustrate a structure of a processing tray unit 50. The processing tray unit 50 has the processing tray 14 on which the bunch of papers B is mounted as described above. The transverse matching plate 16 is provided on the both sides of the processing tray 14, and transverse matching plate 16 moves in the left and right direction, thereby matching lateral ends of the bunch of papers B before stapling. In addition, two longitudinal matching rollers 17 bring the rear ends of the bunch of papers B on the processing tray 14 into contact with the rear stopper 26 to be matched longitudinally.

As the post-processing performed by the finisher 1, there is a sorting in addition to the stapling. In the sorting process, a predetermined number of papers are matched transversely and longitudinally as one unit of sorting and are alternately shifted for each unit of sorting in a transverse direction (left and right) to discharge to the loading tray 23. The shift in the transverse direction is performed by use of the transverse matching plate 16.

The bunch of papers B for which the post-processing (the stapling or the sorting) is performed are discharged to the loading tray 23 from the processing tray 14 by a belt driving mechanism 60 (refer to FIGS. 9 and 10) or four discharge rollers 22. The belt driving mechanism 60 may include the bunch claw belt 21, the bunch claw 21*a* fixed to the bunch claw belt 21, two eject belts 30 disposed on both sides of the bunch claw belt 21 in parallel, and the ejector 20 or the protruding rod 25 fixed to the eject belt 30.

Figure 7:
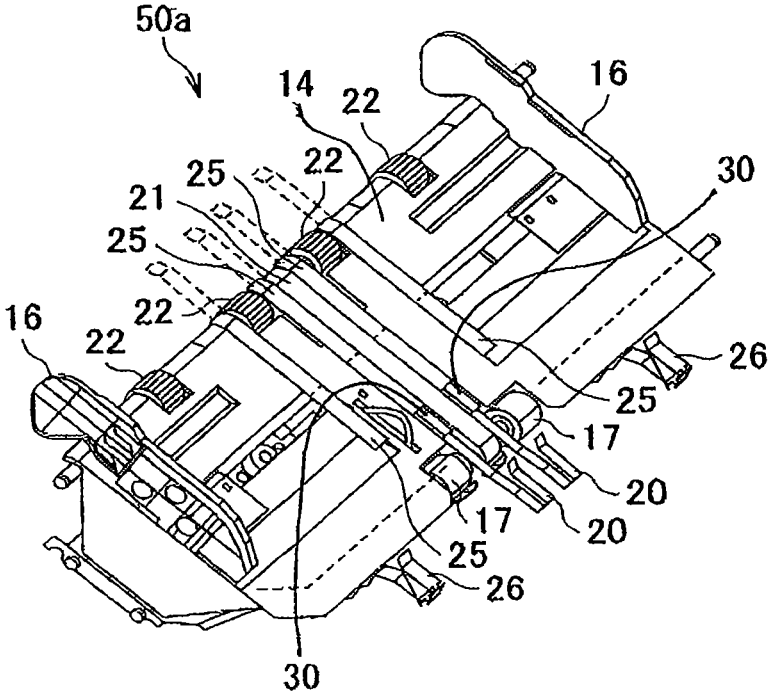
FIG. 7 is a perspective view to illustrate an exemplary configuration of a processing tray unit related to another embodiment.

Moreover, an embodiment including four protruding rods 25 may be possible like a processing tray unit 50*a* shown in FIG. 7. Each one of the same protruding rods 25 may be provided on both outsides of two protruding rods 25 fixed to the eject belt 30. Two outside protruding rods 25 and two inside protruding rod 25 are configured to move mutually synchronously. Since the processing tray unit 50*a* can support the bunch of papers B in a wide range in the transverse direction for protrusion toward the loading tray 23, mismatch of a position is less, thereby carrying them stably.

Figure 8:
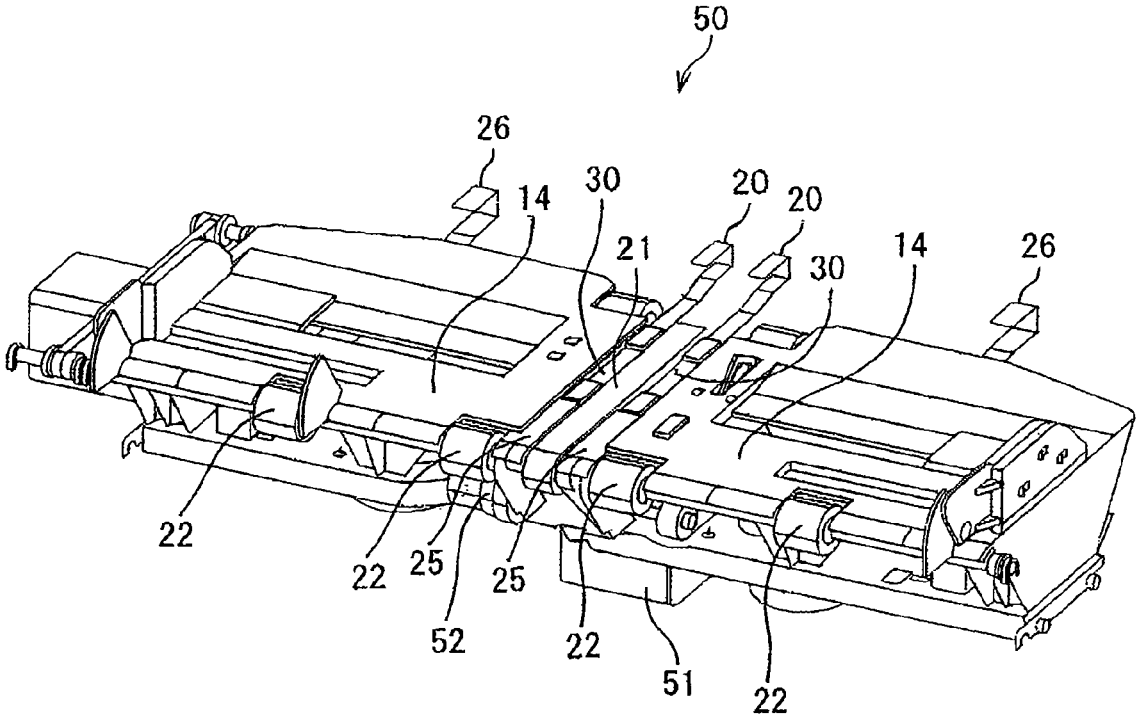
FIG. 8 is a second perspective view to illustrate the exemplary configuration of the processing tray unit.

FIG. 8 is a perspective view of the processing tray unit 50 seen from an angle different from the FIG. 6. On the lower portion of the processing tray unit 50, a motor 51 which is a driving source of the bunch claw belt 21 and the eject belt 30, and an electromagnetic clutch 52 for connecting and disconnecting a transmission of driving force to the eject belt 30 are positioned. The motor 51 and the electromagnetic clutch 52 are components of the belt driving mechanism 60 as well.

(2) Belt Driving Mechanism and Belt Driving Method

Figure 9:
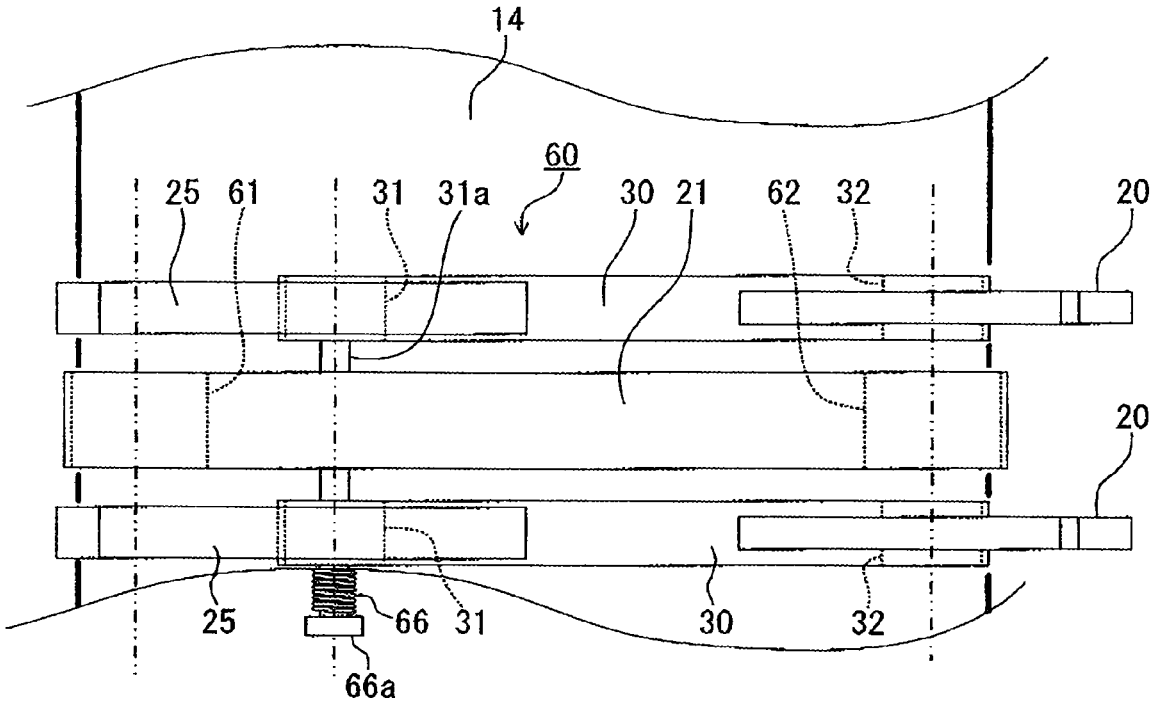
FIG. 9 is a plan view to schematically illustrate a configuration of a belt driving mechanism related to the present embodiment.
Figure 10:
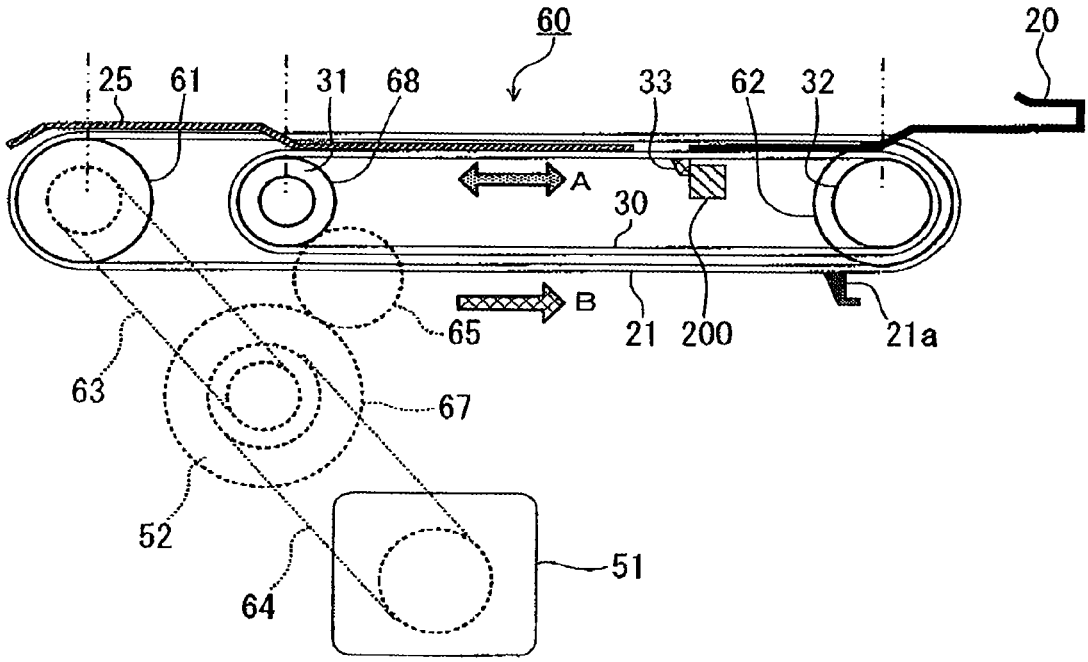
FIG. 10 is a side view to schematically illustrate a configuration of the belt driving mechanism related to the present embodiment.

FIG. 9 is a plan view to schematically illustrate an exemplary configuration of the belt driving mechanism 60 mainly, and FIG. 10 is a side view to schematically illustrate the exemplary configuration of the belt driving mechanism 60.

The belt driving mechanism 60 related to the present embodiment includes the bunch claw belt 21 disposed at the near center of the processing tray 14 and two eject belts 30 disposed on both sides of the bunch claw belt 21, as shown in FIG. 9.

The bunch claw belt 21 hangs on a pair of conveyance pulleys 61 and 62 and continuously rotates in a counterclockwise direction indicative of the arrow B (refer to FIG. 10). The bunch claw 21*a* is fixed to a specific position of the outer circumference of the bunch claw belt 21. The bunch claw 21*a* also continuously rotates in a counterclockwise direction accompanied by the rotation of the bunch claw belt 21.

The bunch claw belt 21 is driven by the rotation of the motor 51. The rotational force of the motor 51 is transmitted to the electromagnetic clutch 52 by a transmission belt 64 and further is transmitted to the conveyance pulley 61 (driving pulley) by a transmission belt 63.

The rotation of the motor 51 is always transmitted to the conveyance pulley 61 without the electromagnetic clutch 52 turning on and off, as to driving transmission to the bunch claw belt 21.

Two eject belts 30 hang between a toothed drive pulley 31 and a toothed driven pulley 32, respectively, and are configured to go and return as indicated by the arrow A (refer to FIG. 10)

The ejector 20 for hooking end portions of the rear side of the bunch of papers B and the protruding rods 25 for supporting and protruding lower portions of the front side of the bunch of papers B are fixed to the outer circumference of the eject belt 30.

The ejector 20 is formed by, for example, bending a head portion of a ribbon-shaped metal plate into a U-shape and can hook the rear end portion of the bunch of papers B stably.

The head portion of the protruding rod 25 is slightly bent downwardly and a resin such as rubber for increasing a frictional force on its surface is attached thereto. Thereby, a stable support of the lower portion of the front side of the bunch of papers B without sliding, and a sure push of the bunch of papers B toward the loading tray 23 are achieved.

Teeth for engaging with the teeth of the toothed pulleys 31 and 32 are formed on the entire inner circumference of the eject belt 30, and thus, even if a sudden force is applied to the toothed pulleys 31 and 32 or the eject belt 30, no sliding occurs.

A belt protrusion 33 (protrusion for stop) is fixed to a specific position of the inner circumference of the eject belt 30. The belt protrusion 33 is position-adjusted in the home position of the eject belt 30 (this home position is also a home position of the ejector 20 or the protruding rod 25) in order to contact to a stopper 200 fixed to an outside of the belt driving mechanism 60 (for example, a suitable structure member of the processing tray unit 50).

A pulley gear 68 which is axial-bonded to the shaft of the toothed drive pulley 31 engages with a middle gear 65, and the middle gear 65 engages with a clutch gear 67 which is axial-bonded to the shaft of the electromagnetic clutch 52. The electromagnetic clutch 52 turns on to transmit the rotation of the motor 51 to the toothed drive pulley 31 to rotate in a counterclockwise direction. The electromagnetic clutch 52 turns off to disengage the rotation of the toothed drive pulley 31 from the motor 51.

On the other hand, one end of a pulley shaft 31*a* of the toothed drive pulley 31 lies within a torsional coil spring 66 (elastic member) as shown in FIG. 9. One end of the torsional coil spring 66 is fixed to the pulley shaft 31*a* and the other end thereof is fixed to the outside of the belt driving mechanism 60 (for example, a suitable structure member of the processing tray unit 50) via a spring fix member 66*a*.

When the electromagnetic clutch 52 turns on, the torsional coil spring 66 is tortured in a counterclockwise direction by the rotation of the motor 51 and thus an elastic force is accumulated on the torsional coil spring 66. When the electromagnetic clutch 52 turns off, the pulley shaft 31*a* separates from the rotation of the motor 51 to be in a free state, and the toothed drive pulley 31 strongly begins to rotate in a reverse direction (clockwise direction) by releasing the elastic force accumulated in the torsional coil spring 66. The eject belt 30 also begins to move in the reverse direction by the rotation in the reverse direction, and finally stops at a position where the belt protrusion 33 and the stopper 200 are contacted. As above, the eject belt 30 can perform a reciprocating motion by turning on and turning off of the electromagnetic clutch 52.

A series of operations of the belt driving mechanism 60 configured as described above will be described with reference to FIGS. 11 to 14.

Figure 11:
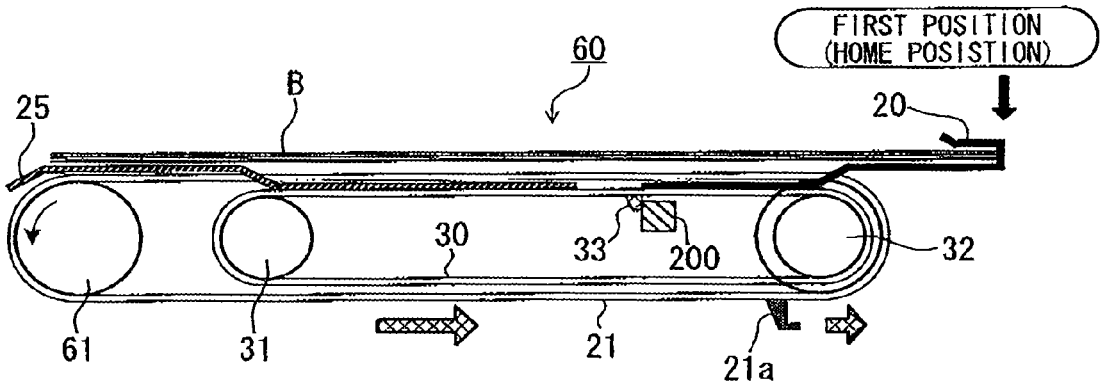
FIG. 11 is a view to illustrate a first operation of the belt driving mechanism.

FIG. 11 illustrates a state where the eject belt 30 (and the ejector 20 or the protruding rod 25 fixed to the eject belt 30) lies in the home position (first position). The ejector 20 is stopped, hooking the rear end of the bunch of papers B, at nearly the same position as the rear stopper 26.

When the ejector 20 and the like lie in the home position, the transverse matching or the longitudinal matching is performed for the bunch of papers B by the transverse matching plate 16 or the longitudinal matching roller 17, and then the stapling is performed therefor by the stapler 19.

When the eject belt 30 lies in the home position, the electromagnetic clutch 52 is turned off and the toothed drive pulley 31 is separated from the rotation of the motor 51. The eject belt 30 stops with the belt protrusion 33 being in contact with the stopper 200.

Even when the ejector 20 or the like lies in the home position, the bunch claw belt 21 continuously keeps rotating in a counterclockwise direction. Right before the ejector 20 and the like begin to move from the home position, the bunch claw 21*a* on the bunch claw belt 21 is moving, for example, the vicinity under the toothed driven pulley 32 located on the right hand side or the eject belt 30.

Figure 12:
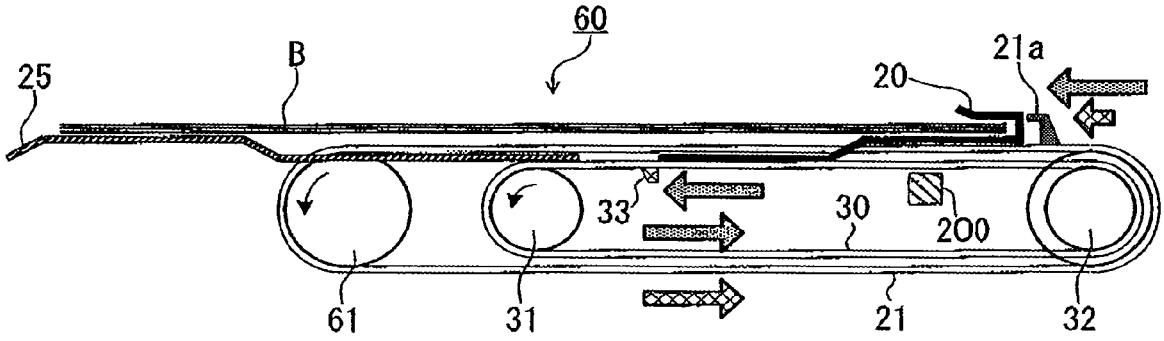
FIG. 12 is a view to illustrate a second operation of the belt driving mechanism.

FIG. 12 illustrates a case where time elapses for a moment after the electromagnetic clutch 52 turns on in the state of FIG. 11. When the electromagnetic clutch 52 turns on in the state of FIG. 11 (the state where the eject belt 30 lies in the home position and the bunch claw 21*a* is moving the vicinity under the toothed driven pulley 32), the toothed drive pulley 31 begins to rotate in a counterclockwise direction. The eject belt 30 (and the ejector 20 or the protruding rod 25) begins to move in the left direction of the figure (going direction), and the belt protrusion 33 and the stopper 200 depart from each other. The bunch of papers B is hooked in the rear end thereof by the ejector 20, supported in the front end side by the protruding rods 25, and carried to the loading tray 23 from the processing tray 14.

Concurrently, the torsional coil spring 66 is coiled up by the rotation of the toothed drive pulley 31 to accumulate an elastic force gradually.

Meanwhile, the bunch claw belt 21 keeps rotating, and the bunch claw 21*a* approaches the ejector 20 from the rear side thereof in a state shown in FIG. 12.

Figure 13:
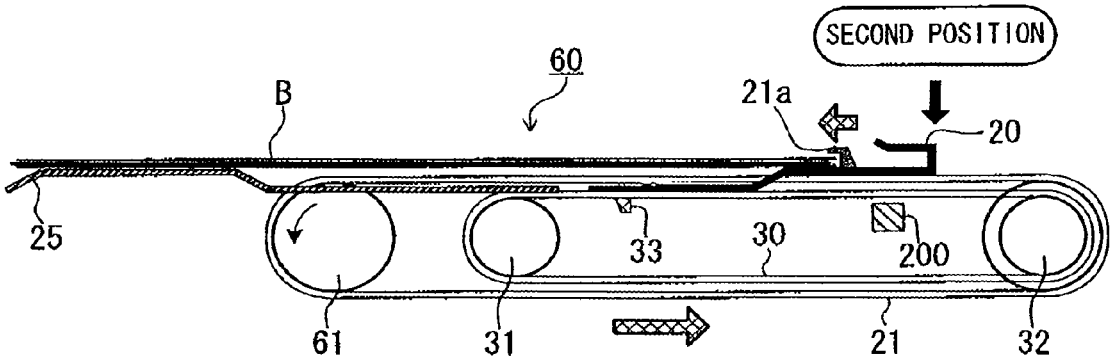
FIG. 13 is a view to illustrate a third operation of the belt driving mechanism.

When the ejector 20 reaches a predetermined second position, the electromagnetic clutch 52 is turned off. Before the ejector 20 reaches the second position (i.e., before the electromagnetic clutch 52 is turned off), the bunch claw 21*a* outruns the ejector 20, and the hooking of the rear end of the bunch of papers B is relayed to the bunch claw 21*a* from the ejector 20. After that, the bunch of papers B are carried by the bunch claw 21*a*, as shown in FIG. 13.

Figure 14:
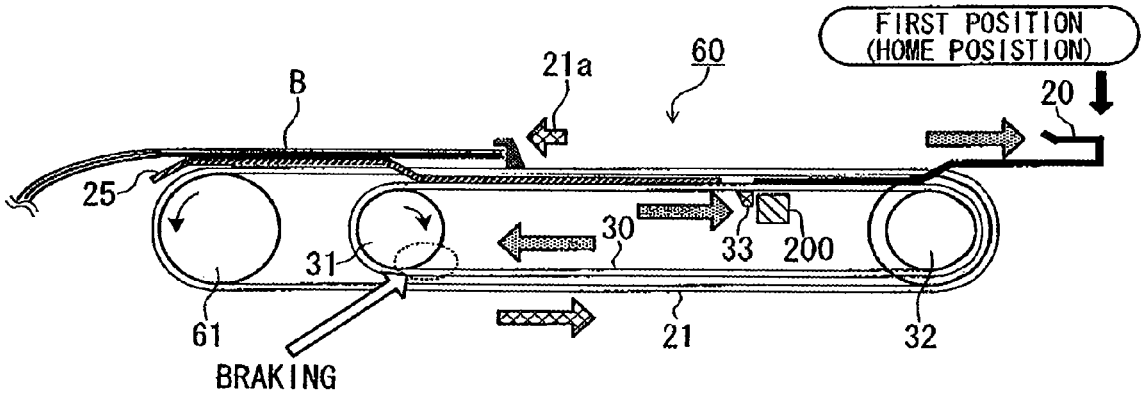
FIG. 14 is a view to illustrate the fourth operation of the belt driving mechanism.

When the electromagnetic clutch 52 turns off, as shown in FIG. 14, the toothed drive pulley 31 begins to rotate in an opposite direction (clockwise direction) by the elastic force accumulated in the torsional coil spring 66 and the ejector 20 goes toward the home position in a returning direction while increasing a velocity.

In order to stop the eject belt 30 at the home position, the existing art only depends on a contact between the belt protrusion 33 and the stopper 200. As a result, the accelerated belt protrusion 33 collides with the stopper 200 fiercely to generate an unpleasant impact sound.

In contrast, the belt driving mechanism 60 related to the embodiment brakes the eject belt 30 right before the belt protrusion 33 collides with the stopper 200 to reduce a velocity of the eject belt 30, thereby preventing generation of an impact sound.

Specifically, the eject belt 30 is braked by increasing a tension of the eject belt 30 right before the belt protrusion 33 collides with the stopper 200.

The increase of the tension of the eject belt 30 is carried out by forming a shallower tooth bottom of the tooth of at least one of the eject belt (toothed belt) 30, the toothed drive pulley 31, and the toothed driven pulley 32, than a normal tooth bottom.

Figure 15:
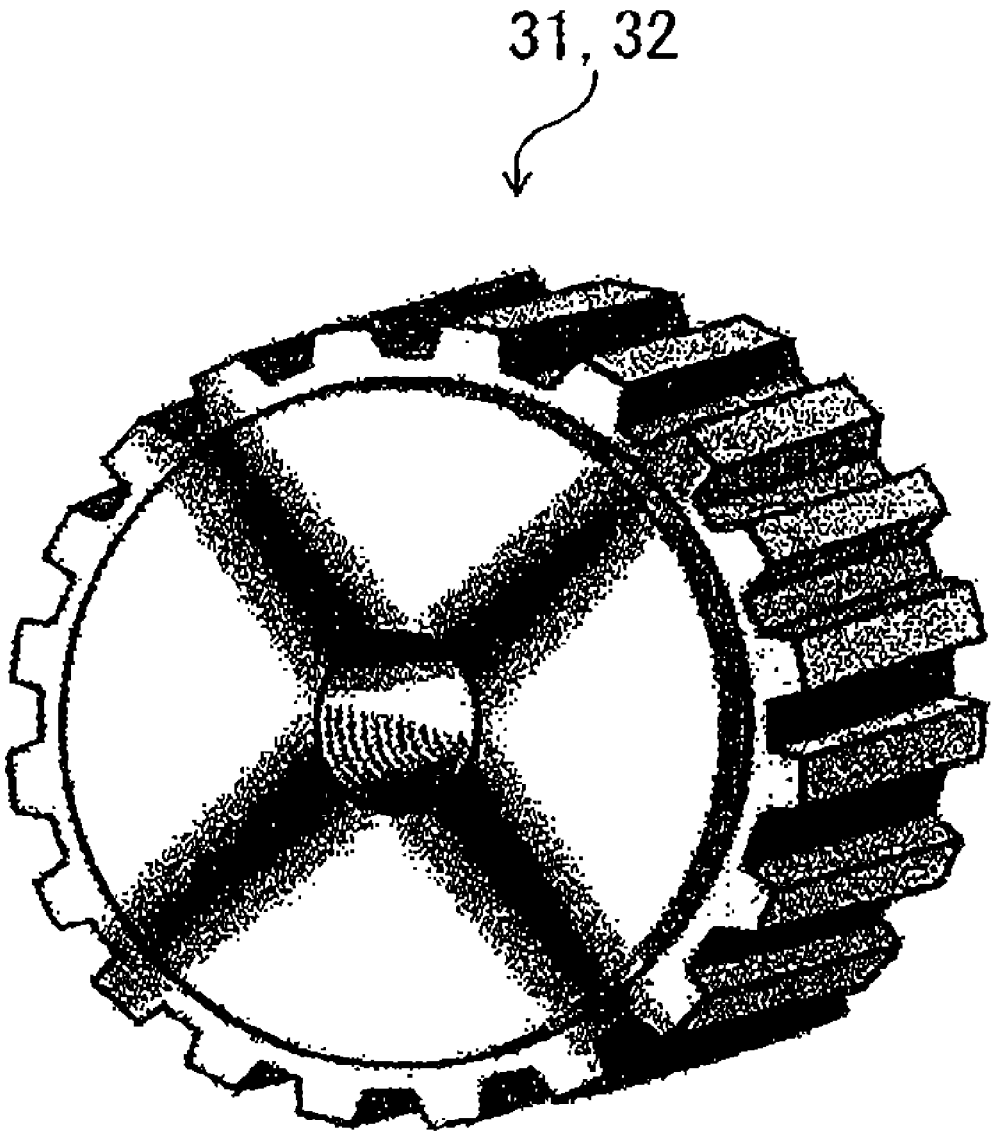
FIG. 15 is a perspective view to illustrate an example of an appearance of a toothed pulley.

FIG. 15 is a perspective view of an appearance of an exemplary shape of the toothed pulleys 31 and 32. Teeth are formed on the outer circumference of the toothed pulleys 31 and 32 such as those shown in FIG. 15.

In the conventional eject belt, the teeth with a typical depth are formed on the entire inner circumference thereof, and the teeth of the toothed drive pulley (or the toothed driven pulley) and the teeth of the eject belt rotate engaging with each other. In the conventional eject belt and the toothed drive pulley (or the toothed driven pulley), the eject belt is applied with almost uniform tension at any rotational positions and thus a smooth rotation is possible.

In contrast, in the eject belt 30 related to the present embodiment, as shown in FIGS. 16 to 19 as Examples, the tooth bottom of the eject belt 30 is made shallow at a position right before collision of the belt protrusion 33 and the stopper 200 (at a position right before the ejector 20 returns to the home position (the first position)), thereby increasing a tension of the eject belt 30.

More in detail, a shape where the saw tooth bottom becomes shallower is formed on the vicinity of a position where the toothed drive pulley 31 and the eject belt 30 begin to engage with each other.

By making the tooth bottom of the eject belt 30 shallow on the driving side, vibration of the eject belt 30 does not easily occur, and therefore, a stable and accurate braking performance is obtained.

On the driven side where the toothed driven pulley 32 and the eject belt 30 engage with each other, a shallow tooth bottom of the eject belt 30 can increase a tension of the eject belt 30.

If a moving distance (a distance of the going path or the returning path) of the eject belt 30 is shorter than a circumference length of the toothed drive pulley 31, a shallow tooth bottom of the toothed drive pulley 31 can increase a tension, too.

Figure 16:
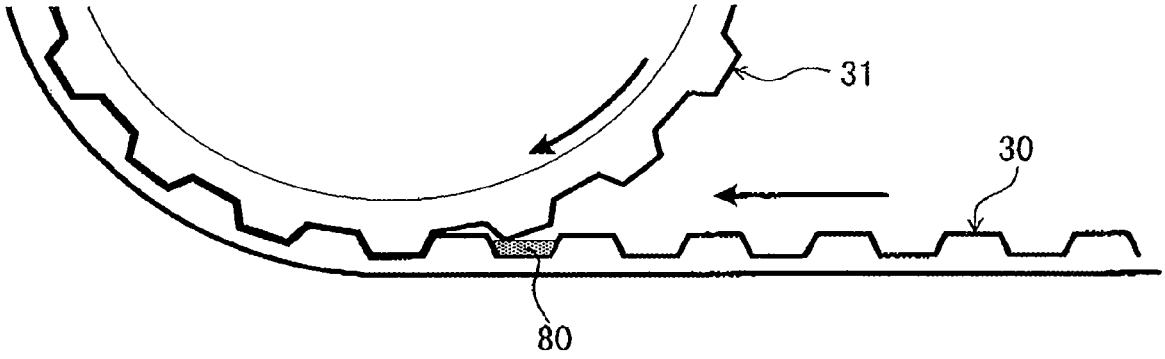
FIG. 16 is a diagram to illustrate the first Example to increase a tension of an eject belt for braking in the belt driving mechanism related to the present embodiment.

FIG. 16 illustrates an example to realize a shape where the tooth bottom becomes shallow by attaching a cushion member 80 having a lower elastic modulus than that of material (for example, rubber) of the eject belt 30 to the normal tooth bottom of the eject belt 30.

A tension of the eject belt 30 increases when the tooth of the toothed drive pulley 31 contacts to the cushion member 80, and the increase of the tension brakes the eject belt 30.

Figure 17:
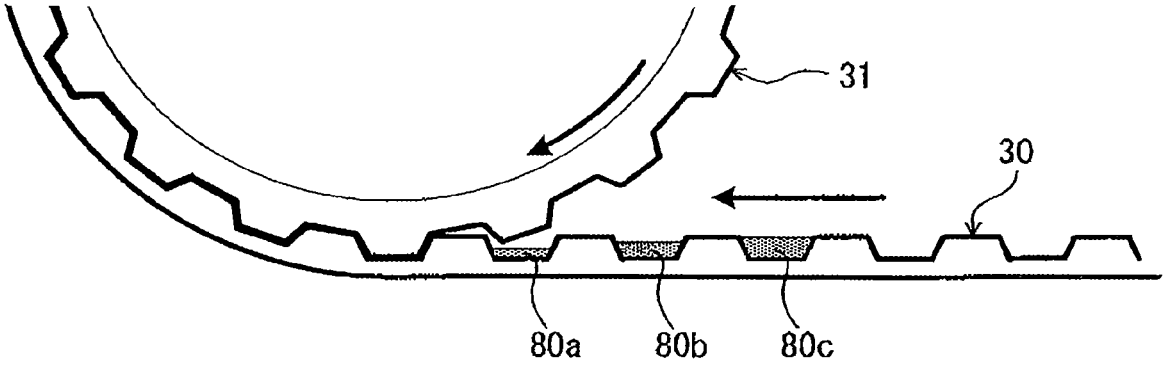
FIG. 17 is a diagram to illustrate the second Example to increase a tension of the eject belt for braking in the belt driving mechanism related to the present embodiment.

FIG. 17 illustrates an example to form the tooth bottoms such that a plurality of continuous tooth bottoms 80*a*, 80*b* and 80*c* become shallow gradually. The tooth bottoms become shallow gradually, and thereby a smooth braking of the eject belt 30 is possible.

Figure 18:
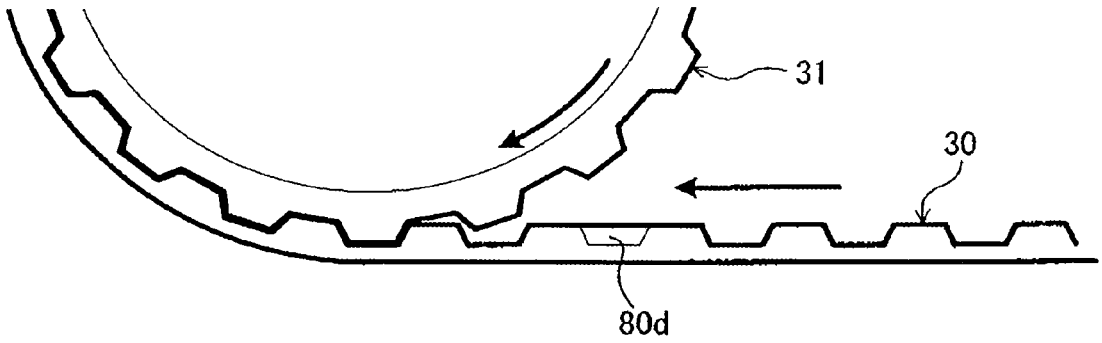
FIG. 18 is a diagram to illustrate the third Example to increase a tension of the eject belt for braking in the belt driving mechanism related to the present embodiment.

FIG. 18 illustrates an example to obtain a shape where the tooth bottom is shallow by filling one or a plurality of continuous saw tooth bottoms completely to make a predetermined region identical to a height of the saw tooth top. The saw tooth of the toothed drive pulley 31 contacts to the shape 80*d* with no tooth bottom to increase a tension of the eject belt 30, thereby braking the eject belt 30.

Figure 19:
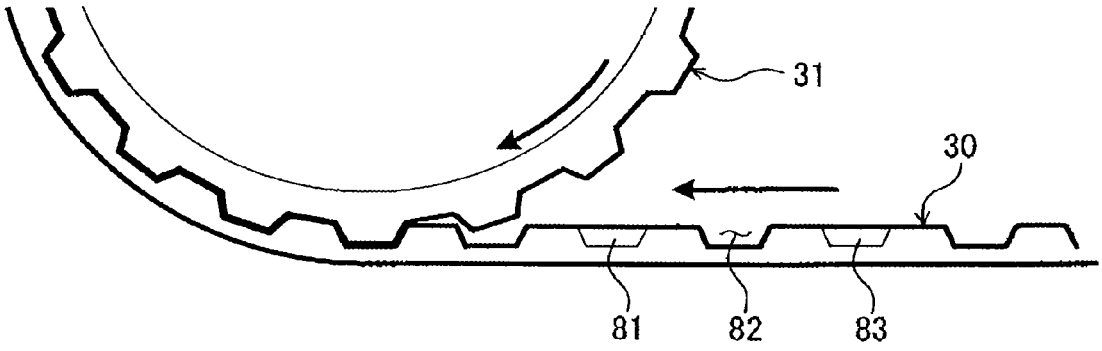
FIG. 19 is a diagram to illustrate the fourth Example to increase a tension of the eject belt for braking in the belt driving mechanism related to the present embodiment.

FIG. 19 illustrates an example to implement a shape where the saw tooth bottom is shallow by a first region 81 where the saw tooth bottom is shallow, a second region 82 where the saw tooth bottom has a normal depth, adjacent to the first region 81, and a third region 83 where the saw tooth bottom is shallow, adjacent to the second region. The eject belt 30 is braked preliminarily at the first region 81 and again braked at the third region 83. As such, the eject belt 30 is braked at two stages, and thereby smoother and more accurate braking and stop can be realized.

As described above, according to the belt driving mechanism, the image forming apparatus including the same and the belt driving method of the embodiments, a tension of the belt increases using a very simple configuration right before the belt stops and thereby the belt can stop smoothly without generating an impact sound, in the belt driving mechanism to perform a reciprocating motion.

The present invention is not limited to the embodiments as they are but can modify the elements to be embodied in a range of not departing from a gist thereof. In addition, a variety of embodiments of the invention can be made by a proper combination of a plurality of elements disclosed in the respective embodiments. For example, several elements may be removed from the overall elements shown in the embodiments. Further, elements extending over other embodiments may be combined properly.

What is claimed is:

1. A belt driving mechanism comprising:

a toothed drive pulley configure to rotate actively;

a toothed driven pulley configured to rotate passively;

a toothed belt configured to engage with the toothed drive pulley and the toothed driven pulley by tooth on an inner circumference thereof; and an elastic member configured to move the toothed belt in a returning direction by an elastic force accumulated while the toothed drive pulley moves the toothed belt in a going direction, wherein at least one of the toothed belt, the toothed drive pulley, and the toothed driven pulley is formed such that at least one of tooth bottoms is shallower than at least other one of the tooth bottoms.

2. The mechanism of claim 1, further comprising a hook on an outer circumference of the toothed belt, configured to hook a bunch of papers.

3. The mechanism of claim 2, wherein, the toothed belt moves in the going direction to transfer the hook from a first position to a second position, and the elastic force of the elastic member moves the toothed belt in the returning direction to return the hook from the second position to the first position.

4. The mechanism of claim 3, wherein the shallower tooth bottom is formed on a portion of the toothed belt side.

5. The mechanism of claim 4, wherein the shallower tooth bottom is formed on a position where the toothed drive pulley and the toothed belt begin to engage with each other at a position before the hook returns to the first position.

6. The mechanism of claim 4, wherein the shallower tooth bottom is formed by attaching a cushion member with a lower elastic modulus than that of material of the teeth of the toothed belt to the tooth bottom.

7. The mechanism of claim 4, wherein the shallower tooth bottom is formed such that the tooth bottoms of a plurality of continuous teeth become shallower gradually.

8. The mechanism of claim 4, wherein the shallower tooth bottom is formed by filling one or a plurality of continuous tooth bottoms completely to make a predetermined region identical to a height of a tooth top.

9. The mechanism of claim 4, wherein the shallower tooth bottom is formed by a first region where the tooth bottom is shallow, a second region where the tooth bottom has a normal depth, adjacent to the first region, and a third region where the tooth bottom is shallow, adjacent to the second region.

10. The mechanism of claim 4, further comprising:

a motor, and an electromagnetic clutch configured to connect or disconnect a rotation of the motor and a rotation of the toothed drive pulley, wherein the electromagnetic clutch is connected when the hook moves from the first position to the second position, and the electromagnetic clutch is disconnected when the hook returns from the second position to the first position.

11. The mechanism of claim 10, wherein the elastic member is a torsional coil spring attached to a rotational shaft of the toothed drive pulley.

12. The mechanism of claim 1, wherein a protrusion for stop is further formed on the toothed belt; and wherein the toothed belt stops by the protrusion for stop contacting to a stopper provided on a predetermined position of an outside thereof after braked by the increase of the tension.

13. The mechanism of claim 4, further comprising a conveyance belt configured to be disposed in parallel with the toothed belt and continuously rotating between a pair of conveyance pulleys, and a conveyance hook on an outer circumference of the conveyance belt, wherein the conveyance hook hooks the bunch of papers relayed from the hook on the toothed belt, between the first position and the second position, and carries the bunch of papers up to further front of the second position.

14. The mechanism of claim 13, wherein two of the toothed belts are disposed on both sides of the conveyance belt.

15. The mechanism of claim 1, wherein a rod-shaped member for supporting and pushing a lower surface of an opposite side of the end portion of the bunch of papers is fixed to the outer circumference of the toothed belt.

16. An image forming apparatus comprising:

a printer configured to print images on a plurality of papers;

a processing tray configured to stack the plurality of papers to match end portions of the plurality of papers;

a stapler configured to staple the plurality of papers;

a toothed drive pulley configure to rotate actively;

a toothed driven pulley configured to rotate passively;

a toothed belt configured to engage with the toothed drive pulley and the toothed driven pulley by tooth on an inner circumference thereof; and an elastic member configured to move the toothed belt in a returning direction by an elastic force accumulated while the toothed drive pulley moves the toothed belt in a going direction, wherein at least one of the toothed belt, the toothed drive pulley, and the toothed driven pulley is formed such that at least one of tooth bottoms is shallower than at least other one of the tooth bottoms.

17. The apparatus of claim 16, wherein the shallower tooth bottom is formed on a position where the toothed drive pulley and the toothed belt begin to engage with each other at a position before the hook returns to the first position.

18. The apparatus of claim 16, wherein further comprising:

a motor, and an electromagnetic clutch configured to connect or disconnect a rotation of the motor and a rotation of the toothed drive pulley, wherein the electromagnetic clutch is connected when the hook moves from a first position to a second position, and the electromagnetic clutch is disconnected when the hook returns from the second position to the first position, and the elastic member is a torsional coil spring attached to a rotational shaft of the toothed drive pulley.

19. The apparatus of claim 16, further comprising:

a loading tray configured to be disposed adjacent to the other end of the processing tray opposite side to the stapler, and to load the bunch of filed papers, a conveyance belt configured to be disposed in parallel with the toothed belt and continuously rotating between a pair of conveyance pulleys, and a conveyance hook on an outer circumference of the conveyance belt, wherein the conveyance hook hooks the bunch of papers relayed from the hook on the toothed belt, between the first position and the second position, and carries the bunch of papers up to the loading tray which is located in further front of the second position.

20. A method for driving a belt of a toothed belt configured to engage with a toothed drive pulley and a toothed driven pulley by tooth on an inner circumference thereof; and to have a hook on an outer circumference thereof to hook an end portion of a bunch of post-processed papers, comprising:

moving the toothed belt in a going direction to move the hook from a first position to a second position, by a driving force of a motor; and moving the toothed belt in a returning direction to return the hook from the second position to the first position, by an elastic force accumulated in an elastic member while the toothed drive pulley moves the toothed belt in a going direction, wherein at least one of the toothed belt, the toothed drive pulley, and the toothed driven pulley is formed such that at least one of tooth bottoms is shallower than at least other one of the tooth bottoms.

* * * * *